United States Patent [19]

Roccaforte et al.

[11] 3,961,706

[45] June 8, 1976

[54] COMBINED PACKER AND DISPLAY CARTON

[75] Inventors: Harry I. Roccaforte, Western Springs; Herbert L. Lambert, Glendale Heights, both of Ill.

[73] Assignee: Hoerner Waldorf Corporation, St. Paul, Minn.

[22] Filed: May 16, 1975

[21] Appl. No.: 578,154

[52] U.S. Cl. ..... 206/44 R; 206/45.14; 229/41 C; 229/51 TS

[51] Int. Cl.[2] ..... B65D 5/50

[58] Field of Search ..... 206/44 R, 44.12, 45.11, 206/45.12, 45.14, 45.18, 45.31, 45.34, 491; 229/16 D, 37 R, 37 B, 41 C, 51 TS

[56] References Cited

UNITED STATES PATENTS

| | | | |
|---|---|---|---|
| 1,925,102 | 9/1933 | Levkoff | 206/45.12 |
| 2,654,470 | 10/1953 | Borucki | 206/45.14 |
| 3,493,103 | 2/1970 | Cote | 206/45.14 |
| 3,584,740 | 6/1971 | Hanson | 206/45.14 |
| 3,592,337 | 7/1971 | Phillips, Jr. | 206/44 R |

*Primary Examiner*—Steven E. Lipman
*Attorney, Agent, or Firm*—Jerry F. Best

[57] ABSTRACT

A combined packer and display carton comprises a multi-sided tuck end carton having a bottom closure and a tuck flap hinged to the top of the front panel. The tuck flap is connected to the adjoining side walls by triangular tabs including diagonally extending fold lines to web connect the side walls to the top panel. A weakened line of separation extends from the center of the side walls and across the front panel. When separated along this weakened line, and removing the carton contents, the upper portion above the weakened line of separation can be folded back to line the inner surfaces of the side walls and rear wall with a printed display surface to provide a display when the carton contents are replaced.

5 Claims, 7 Drawing Figures

COMBINED PACKER AND DISPLAY CARTON

This invention relates to an improvement in a combined packer and display carton and deals particularly with a carton in which a product may be shipped, and which may be used to display the carton to prospective customers.

BACKGROUND OF THE INVENTION

Various cartons have been produced for use in containing goods to be sold in retail stores. Usually the goods are removed from the cartons, and at least one such product is displayed in a showcase or display shelf. In many instances, displays are provided for use with the goods to indicate the product, and usually the price for which the product is being sold. The present device lies in the provision of a carton which may be used to contain the product, and which may also serve as the display for the product once the carton has been opened.

SUMMARY OF THE INVENTION

The present invention resides in the provision of a multi-sided carton having parallel front and rear walls connected along their edges by side walls. The carton is provided with a bottom closure, and a cover panel which is hingedly connected to the upper edge of the front wall. A line of perforations extends across the front wall, and rearwardly to the centers of the side walls. Fold lines extend vertically from the ends of the perforated line to the top of the carton. As a result, the contents of the carton may be removed, and the portions of the carton above the perforated line may be forced inwardly until a portion of the front wall above the perforated line may rest against the rear wall, and the forward portions of the side walls may be folded inwardly of the rear portions of the side walls, forming a display carton when the product is replaced into the carton.

A feature of the present invention resides in the provision of side wall closure flaps on the forward portions of said side walls connected to said top closure flap by gusset flaps. If desired, the closure flaps may be secured to the upper edges of the rear portion of the side walls and connected to the closure flaps secured to the front portions of the side wall by fold lines forming a continuation of those in the center of the side walls.

A further feature of the present invention lies in the fact that the top closure flap may extend the full width of the top of the carton and include a tuck flap which extends inwardly of the upper portion of the rear wall when the carton is in closed position.

These and other objects and novel features of the present invention will be more clearly and fully set forth in the following specification and claims.

DETAILED DESCRIPTION OF THE PREFERRED EMBODIMENT

Figure 5:
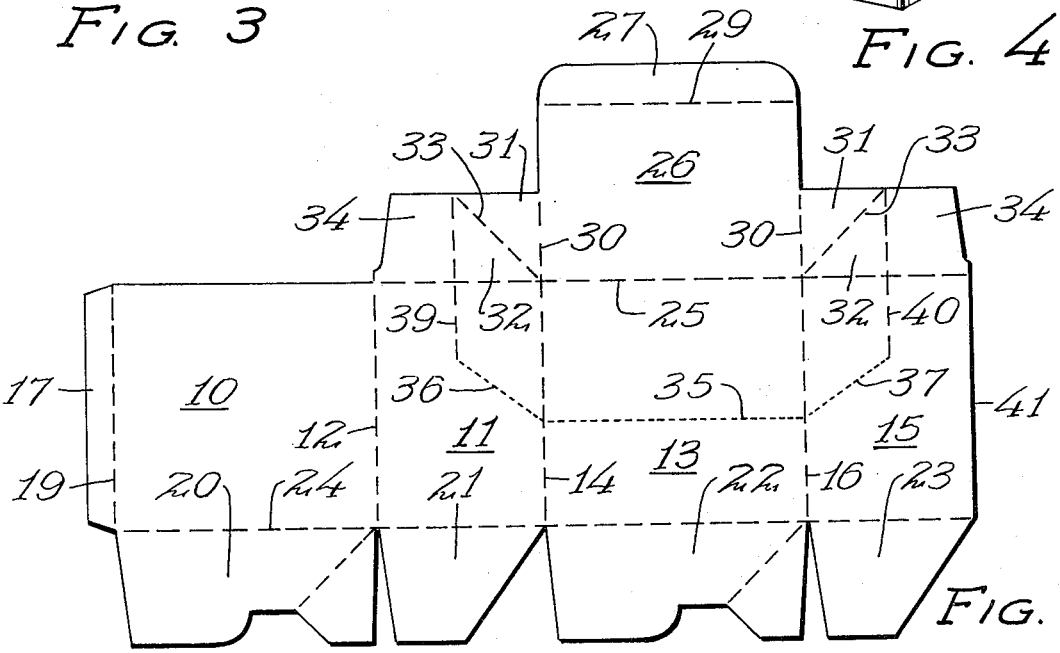
FIG. 5 is a diagrammatic view of the blank from which the carton is formed.

While the carton in question may have any desired cross-sectional shape, it is shown as being rectangular for the purpose of illustration. As is indicated in FIG. 5 of the drawings, the rear wall 10 is connected to a first side wall 11 by a fold line 12. The first side wall 11 is connected to a front panel 13 along a fold line 14. The front panel 13 is connected to the second side wall panel 15 along a fold line 16. A glue flap 17 is connected to an end panel of the series, such as the rear panel 10, along a fold line 19.

Bottom closure flaps 20, 21, 22 and 23 are foldably connected to the lower edges of the rear panel 10, the first side panel 11, the front panel 13, and the second side wall panel 15 along a common line of fold 24. The bottom closure flaps will not be described in detail, as they may be varied in accordance with the manner in which the bottom is to be closed. However, in general, the bottom closure flaps are similar to those shown in U.S. Pat. No. 2,284,283 issued on May 26, 1942 to Ross A. Himes, or similar to those shown in the Patent to Ralph F. Smart issued Oct. 30, 1945 as U.S. Pat. No. 2,388,190. The applicant's assignee has formed bottom closures of this type for many years, and the structure has the advantage that the bottom closure will be formed automatically as the carton is folded into its normal rectangular form. The upper edge of the front wall panel 13 is connected along a fold line 25 to a cover panel 26 which preferably extends entirely across the upper end of the carton and is provided with a tuck flap 27 hingedly connected thereto along a fold line 29. The top closure or cover flap 26 is hingedly connected along its side edges 30 to one of a pair of triangular gusset flaps 31. The gusset flaps 31 are preferably connected to similar gusset flaps 32 along diagonal fold lines 33. The second gusset flaps 32 are hingedly connected to the upper edges of the forward portion of the side walls 11 and 15 along continuations of the fold line 25. The rear portions of the side walls 11 and 15 are preferably provided with closure flaps 34 which are connected to the flaps 32 along extensions of the fold lines 39 and 40 which will be described.

A weakened line of separation 35 extends across the front panel 13, which may be parallel to the fold lines 24 and 25. The weakened line of separation continues from the fold lines 14 and 16 into the side wall panels 11 and 15 as indicated at 36 and 37 which may incline upwardly and rearwardly. The weakened lines 36 and 37 terminate at substantially the transverse center of the panels 11 and 15, and these side walls include central fold lines 39 and 40 which are midway between the fold lines 12 and 14, and midway between the fold line 16 and the free edge 41 of the carton blank. As indicated, the fold lines 39 and 40 extend across the closure flaps connected to the upper edges of the panels 11 and 15 respectively.

Figure 4:
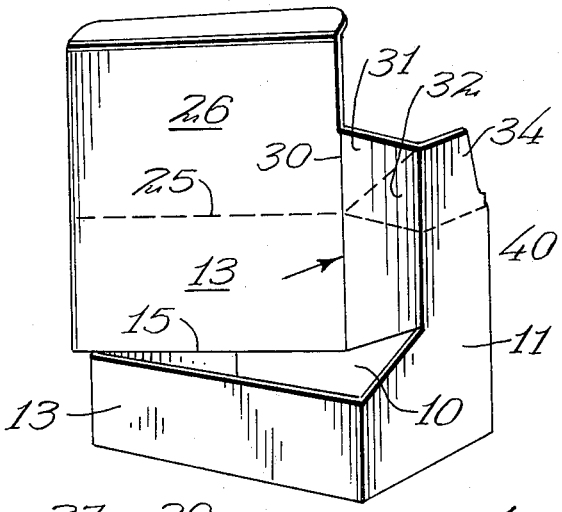
FIG. 4 is a perspective view of the carton in partially folded position.

The bottom of the carton is closed in the conventional manner. In closing the top or cover panel 26, the gusset flaps 31 and 32 connected to the cover panel 26 must be folded into face contact beneath the cover panel, and the tuck flap 27 is folded inwardly of the rear wall 10. The main purpose of the gusset flaps 31 and 32 is to retain the top panel 26 in a vertical position when the carton is open. After removing the contents of the carton, the carton is folded much in the manner illustrated in FIG. 4 of the drawings until the portions of the side walls above the perforated lines 36 and 37 lie against the inner surface of the panels 11 and 15, and the portion of the front wall 13 which is above the weakened line 35 rests against the inner surface of the rear panel 10.

Figure 1:
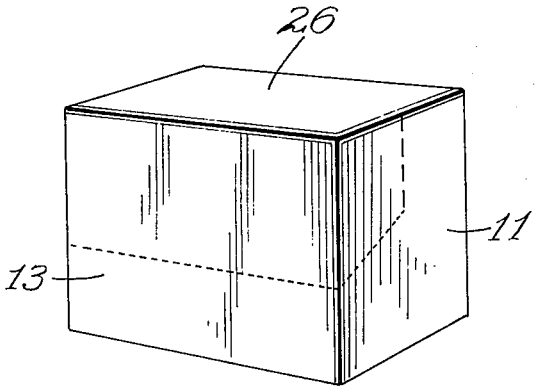
FIG. 1 is a perspective view of the carton in closed position.
Figure 2:
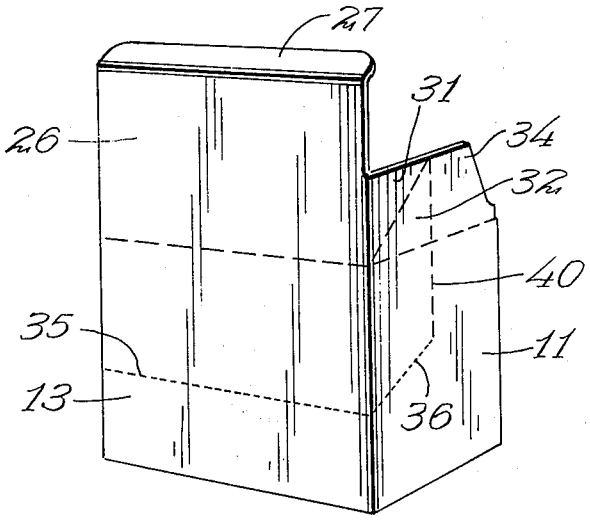
FIG. 2 is a rear elevational view of the carton showing the cover panel in open position.
Figure 3:
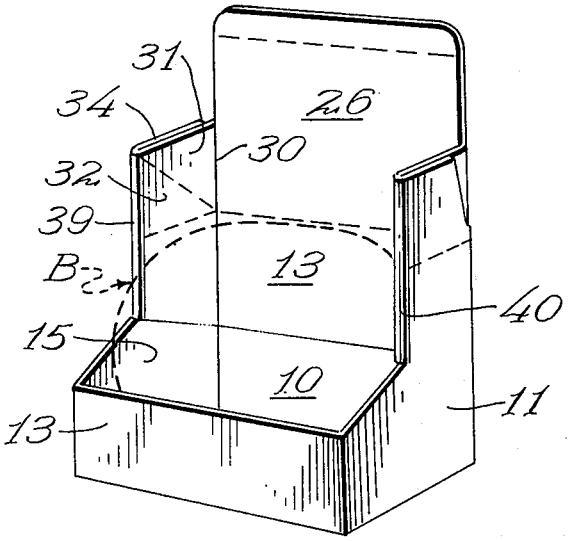
FIG. 3 is a perspective view of the front of the carton with the upper portion of the front wall folded against the inner surface of the rear wall, and with the front portions of the side walls folded against the inner portions of the rear sections of the side walls.

When in open position as described, the printed display on the inwardly folded portions form a display area within the rear portion of the carton. The upper surface of the top or cover panel 26 extends upwardly above the carton contents when they are replaced. The tuck flap 27 tends to unfold to form an upward extension of the cover panel 26 as shown in FIG. 3 of the drawings. The contents B (a helmet radio in the construction) substantially fills the carton when closed and is attractively displayed when the carton is open.

Figure 6:
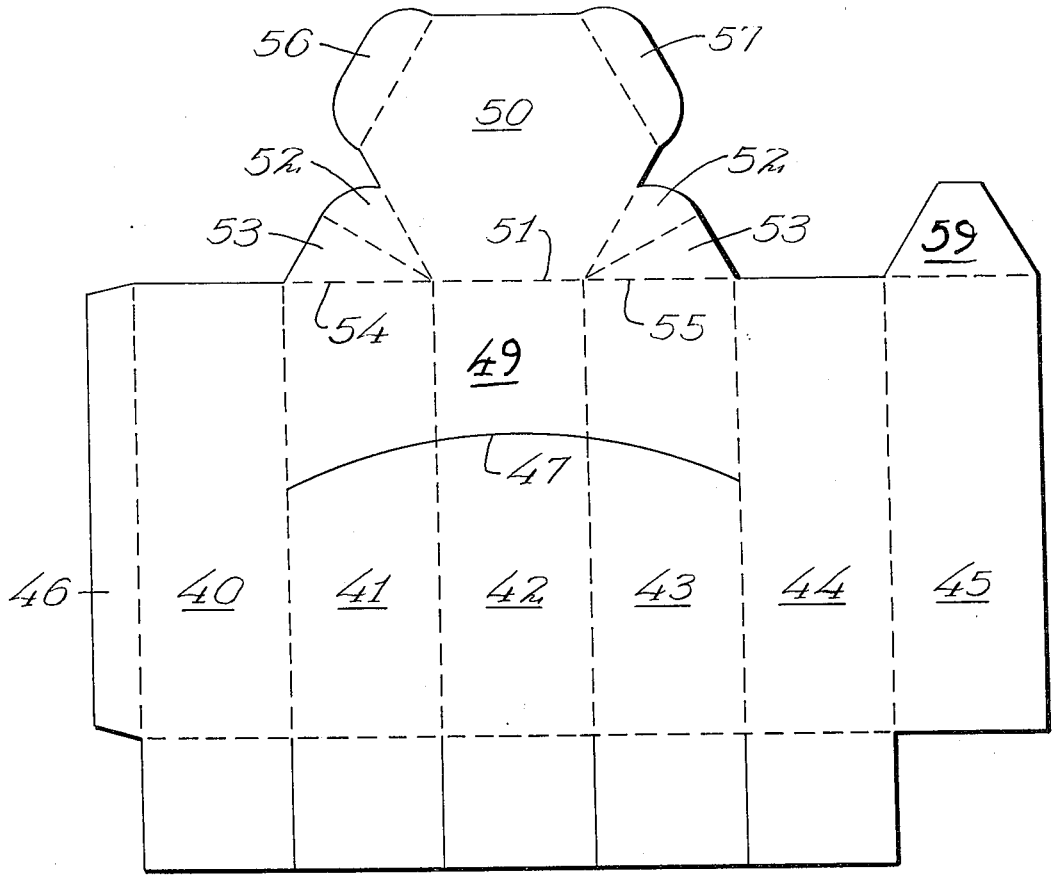
FIG. 6 is a diagrammatic view of the blank of a modified form of construction.

In FIG. 6 we have indicated a carton similar to that shown in the previous Figures, but which is of hexagonal cross section. The purpose of this drawing is merely to indicate that the carton can be made with any number of sides, particularly where the number of sides presents a front panel and a parallel back panel.

The blank shown in FIG. 6 indicates a first side wall panel indicated by the numeral 40 which is connected in series with a second side wall 41, a front wall 42, a side wall 43, an additional side wall 44, and a rear wall 45. A glue flap 46 is connected to one end of the series of walls, and is secured in overlapping relation with the other end wall of the series to provide a tubular hexagonal carton.

The front wall 42, as well as the adjoining side walls 41 and 43 are provided with a cut line 47 so that the upper portions of these walls may be folded back, the upper portion 49 of the front wall may be folded against the rear wall 45, and the upper portions of the side walls 41 and 43 may be folded into face contact with the side walls 40 and 44. A hexagonal cover panel 50 is hingedly connected to the top of the rear panel 42 along a fold line 51, and generally triangular gusset flaps 52 and 53 connect the cover panel 50 with the upper edges 54 and 55 of the panels 41 and 43.

Tuck flaps 56 and 57 are provided on spaced edges of the hexagular top panel 50, and an inner top flap 59 is secured to the upper edge of the panel 45 designed to fold beneath the cover panel 50 opposite to the cover fold line 51.

Figure 7:
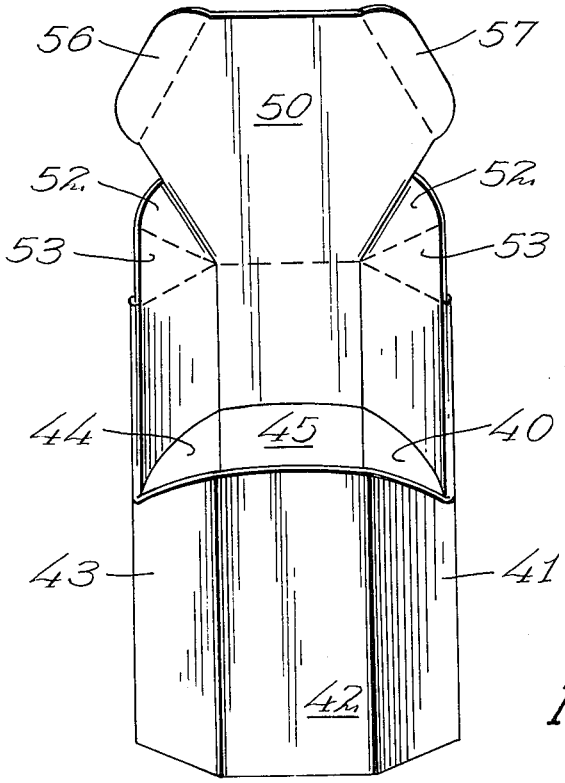
FIG. 7 is a perspective view of the structure of FIG. 7 in its erected form.

When the carton is opened, the contents are removed, and the upper portion of the front panel 42 is pressed against the rear panel 45. The contents of the carton is replaced, and the cover panel remains as indicated in FIG. 7 to provide a display.

In accordance with the Patent Statutes, I have described the principles of construction and operation of my improvement in COMBINED PACKER AND DISPLAY CARTON; and while I have endeavored to set forth the best embodiment thereof, I desire to have it understood that obvious changes may be made within the scope of the following claims without departing from the spirit of my invention.

We claim:

1. A multi-walled carton including:

a rear wall, side walls, and a front wall connected along generally parallel vertical fold lines to provide a multi-sided body, a bottom closure for said rectangular body, a top closure flap secured to said front wall, a continuous weakened line of separation extending across the forward halves of said side walls and across said front wall, fold lines extending upwardly from the rear edges of said weakened line of separation parallel to the vertical edges of said side walls generally midway between the forward and rear edges to the upper edges of said side walls, side wall closure flaps on the forward portions of said side walls connected to said top closure flaps by gusset flaps, side wall closure flaps on the rear portions of said side walls connected to said side wall closure flaps on the forward portions of said side walls along fold lines aligned with said fold lines extending upwardly from the rear edges of said weakened line of separation, whereby, when said weakened line of separation is separated, the forward portions of said walls above said weakened line of separation may be folded to lie inwardly of the rear portions of said side wall and said rear wall to provide a display.

2. The structure of claim 1 and in which the fold lines extending upwardly from the rear edges of said weakened lines of separation also extend downwardly to the lower edges of the side walls, and including separate bottom closure flaps on the portions of the forward portions of the side walls and on the rear portions of the side walls.

3. The structure of claim 2 and in which said top closure flap is hexagonal in shape.

4. The structure of claim 3 and including tuck flaps hingedly connected to two spaced edges of said hexagonal top closure flap.

5. The structure of claim 4 and including a top flap hingedly connected to the upper edge of said front wall and foldable beneath said top closure flap in closed position thereof.

* * * * *